United States Patent [19]

Chamourian

[11] Patent Number: 4,886,184

[45] Date of Patent: Dec. 12, 1989

[54] PLASTIC CONTAINER LID

[75] Inventor: Arto Chamourian, Weston, Ontario, Canada

[73] Assignee: Hamelin Group Inc., Boucherville, Canada

[21] Appl. No.: 299,597

[22] Filed: Jan. 23, 1989

[51] Int. Cl.[4] ..... B65D 41/18; B65D 43/03

[52] U.S. Cl. ..... 220/306; 206/508; 206/519; 220/380

[58] Field of Search ..... 220/306, 380; 206/508, 206/519

[56] References Cited

U.S. PATENT DOCUMENTS

| | | | |
|---|---|---|---|
| 3,353,708 | 11/1967 | Davis | 206/519 |
| 3,373,896 | 3/1968 | Davis | 220/306 |
| 3,519,163 | 7/1970 | Bardell | 220/306 |
| 3,880,288 | 4/1975 | Hunter | 220/306 X |
| 4,407,426 | 10/1983 | McLaren et al. | 206/508 X |
| 4,817,801 | 4/1989 | Schwaikert | 206/508 X |

*Primary Examiner*—Donald F. Norton

*Attorney, Agent, or Firm*—Robert F. Delbridge; Arne I. Fors

[57] ABSTRACT

A plastic container lid is formed by injection molding and comprises a sheet-like main body portion with a downwardly-open hollow upwardly-extending annular projection extending around the periphery of the body portion, the annular projection having an inner wall extending upwardly from the periphery of the body portion, a top wall extending radially outwardly from the top of the inner wall and an outer wall extending downwardly from the outer periphery of the top wall, with the inner and outer walls being substantially equal in height. An annular skirt portion which extends outwardly from the lower end of the outer wall and curves to extend downwardly to a lower annular edge. The skirt portion has an internal annular rib extending around and projecting inwardly from the inner surface of the skirt portion. The internal rib extends inwardly for a distance sufficiently short so as not to reach an imaginary vertical line extending downwardly from a radially outer limit of the outer wall of the upwardly-extending annular projection. Also, the height of the upwardly-extending annular projection above the main body portion is greater than the depth of the skirt portion below the main body portion.

6 Claims, 3 Drawing Sheets

PLASTIC CONTAINER LID

Figure 1:
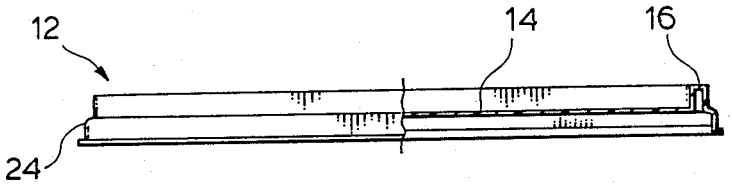

This invention relates to plastic container lids. Present day plastic container lids have to be satisfactory not only as closures but also to fulfill various other requirements. For example, open-topped plastic containers which are intended to contain food are frequently initially closed by a plastic or metal foil which are sealed to the container rim not only to protect the contents from the atmosphere but also to serve as a tamper-evident feature, with any removal or penetration of the foil to gain access to the container contents being readily evident. A lid is used to provide a stronger closure than the foil and also to re-close the container after the foil has been removed. The lid must consequently be capable of being positioned on the container by automated capping equipment without damaging the previously-applied foil.

Also, lids should be stackable for convenience of storage and also readily unstackable by automated capping equipment for application to containers. Lids should also of course be readily removable and replaceable by a user. Further, when it is desired that information should appear on the upper surface of the lid, the lid should be capable of being printed upon by conventional printing equipment.

Many different lid configurations have been proposed in the past, but there is still a need for a plastic lid which meets the above requirements more satisfactorily than prior art lids.

According to the present invention, a plastic container lid is formed by injection molding and comprises a sheet-like main body portion with a downwardly-open hollow upwardly-extending annular projection extending around the periphery of the body portion, the annular projection having an inner wall extending upwardly from the periphery of the body portion, a top wall extending radially outwardly from the top of the inner wall and an outer wall extending downwardly from the outer periphery of the top wall, with the inner and outer walls being substantially equal in height. An annular skirt portion which extends outwardly from the lower end of the outer wall and curves to extend downwardly to a lower annular edge. The skirt portion has an internal annular rib extending around and projecting inwardly from the inner surface of the skirt portion. The internal rib extends inwardly for a distance sufficiently short so as not to reach an imaginary vertical line extending downwardly from a radially outer limit of the outer wall of the upwardly-extending annular projection. Also, the height of the upwardly-extending annular projection above the main body portion is greater than the depth of the skirt portion below the main body portion. These features enable the lid to be stacked upon a like lid with the lower ends of the inner and outer walls of the upwardly-extending annular portion of the upper lid engaging the top wall of the upwardly-extending annular portion of the lower lid.

The internal annular rib is preferably spaced from the lower annular ledge of the skirt portion, and the internal surface of the skirt portion from the internal annular rib to the lower annular edge may be concavely curved. The lower annular edge of the skirt portion may have an annular ledge portion projecting radially outwardly therefrom.

A plastic lid in accordance with the invention can be applied to a plastic container with an open top having a peripheral rim with a turned over downwardly-extending peripheral lip. The inner surface of the lid skirt portion between the upwardly-extending annular projection and the internal annular rib engages the outer surface of the peripheral rim and lip of the container, the internal annular rib of the lip having been snapped past the lower end edge of the peripheral lip into engagement therewith and the inner wall of the upwardly-extending annular projection being spaced radially inwardly from the rim of the container. A foil may extend across the top of the container in sealing engagement with the peripheral rim, with the sheet-like body portion of the lid being adjacent thereto.

Figure 2:
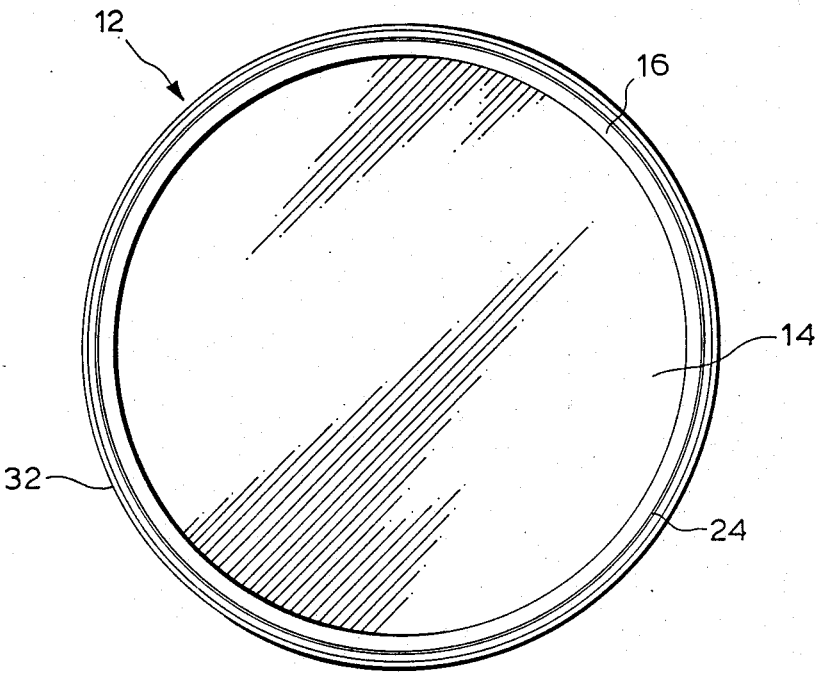
Figure 3:
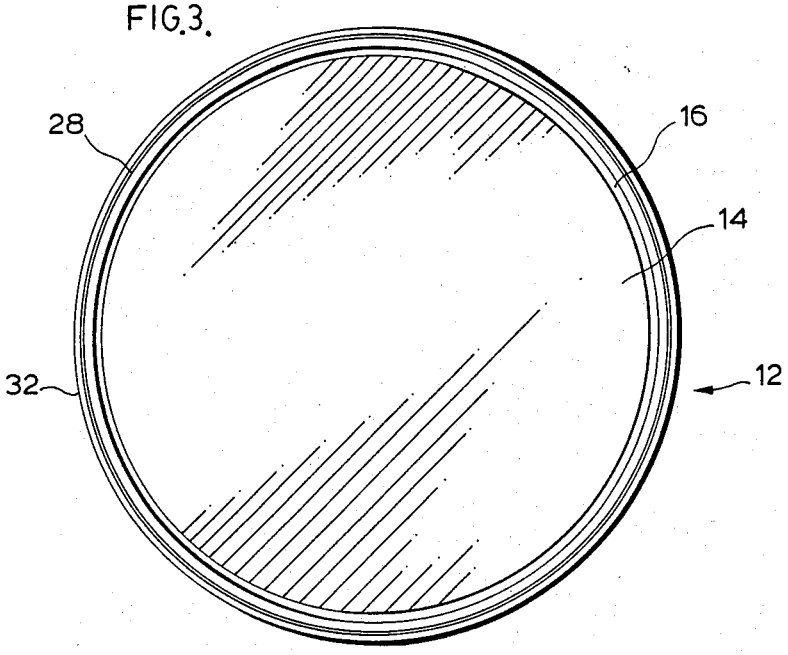
Figure 4:
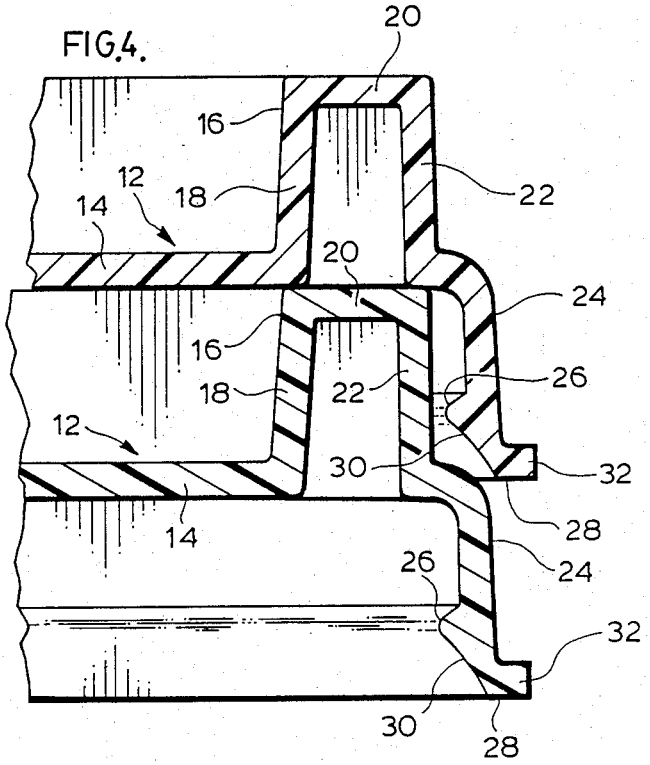
Figure 5:
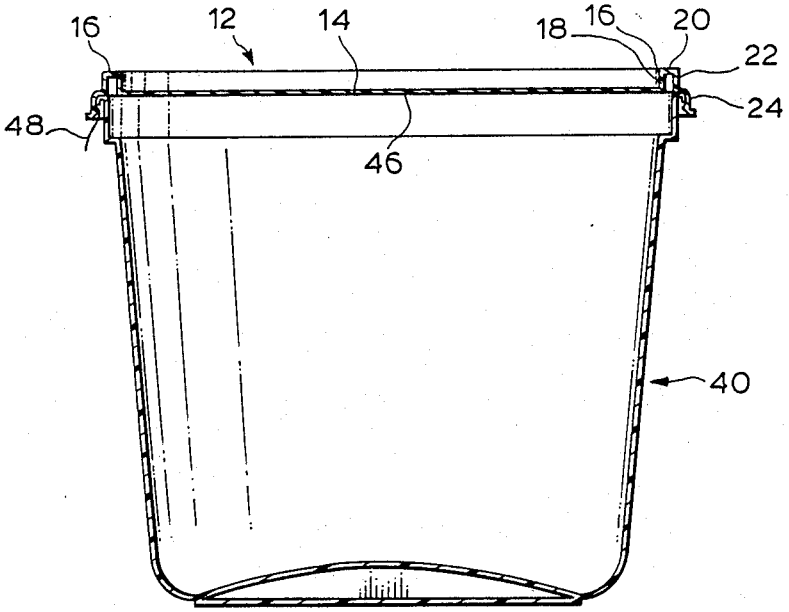
Figure 6:
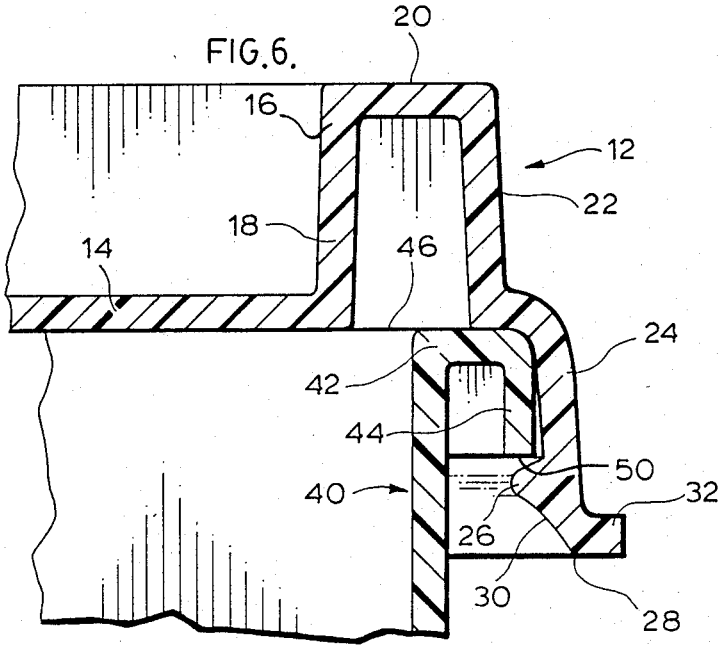

One embodiment of the invention will now be described, by way of example, with reference to the accompanying drawings, of which;

FIG. 1 is a side view, partly in section, of a plastic lid in accordance with the invention, FIG. 2 is a plan view thereof, FIG. 3 is a bottom view thereof, FIG. 4 is an enlarged fragmentary sectional view showing two lids stacked one upon the other, FIG. 5 is a sectional side view of a container with a lid assembled therewith, and FIG. 6 is an enlarged fragmentary sectional view showing the the engagement of the lid with the container.

Referring to the drawings, a circular injection-molded plastic container lid 12 (which may for example be of polyethylene resin) has a sheet-like main body portion 14 and a downwardly-open hollow upwardly-extending annular projection 16 extending around the periphery of the body portion 12. The annular projection 16 has an inner wall 18 extending upwardly from the periphery of the body portion 12, a top wall 20 extending radially outwardly from the top of the inner wall 18 and an outer wall 22 extending downwardly from the outer periphery of the top wall 20, the inner and outer walls 18, 22 being the same height and converging slightly in the upward direction.

An annular skirt portion 24 extends outwardly from the lower end of the outer wall 22 and curves downwardly in a slightly downwardly-diverging manner. The skirt portion 24 has an internal annular rib 26 extending around and projecting inwardly from the internal surface of the skirt portion 24, the rib 26 being spaced above the lower end edge 28 of the skirt portion 24 but nearer to the lower end edge 28 than to the upper end of the skirt portion 24 where the skirt portion 24 joins the lower end of the outer wall 22. The inner surface 30 of the skirt portion 24 between the annular rib 26 and the lower end edge 28 is concavely curved, and the lower end edge 28 has an annular ledge portion 32 projecting radially outwardly therefrom.

The internal annular rib 26 extends inwardly for a distance sufficiently short so as not to reach an imaginary vertical line extending downwardly from the radially outer limit of the outer wall 22 of the upwardly-extending annular projection 16. Also, the height of the annular projection 16 above the main body portion 14 is somewhat greater than the depth of the skirt portion 24 below the main body portion 14. These two features enable lids 12 to be stacked one on top of the other, as shown in FIG. 4, with the lower ends of the inner and outer walls 18, 22 of the upwardly-extending annular projection 16 of the upper lid 12 engaging the top wall 20 of the upwardly-extending annular projection 16 of the lower lid. Also, the clearance between the internal annular rib 26 on the skirt portion 24 of the upper lid 12 and the outer wall 22 of the upwardly-extending annular projection 16 of the lower lid 12 enables the lids to be easily removed from a stack by automated capping equipment.

The lid 12 is intended for use with a plastic open-topped container 40 which has a peripheral rim 42 with a turned-over downward-extending peripheral lip 44. Before applying the lid 12 to the top of the container 40, a thin circular metal or plastic foil 46 is positioned across the open top and sealed in known manner to the rim 42. The foil 46 has a projecting tab 48 to enable a user to remove the foil 46 when desired.

As shown in FIG. 6 lid 12 is applied to the container 40 by positioning the lid 12 on the top of the container 40 and pushing downwardly to cause the internal rib 26 on the skirt portion 24 to snap over the lower edge 50 of the container lip 44 and remain in contact therewith, with the lower end of the wall 22 and the inner surface of the skirt portion 24 of the lid 12 snugly engaging the outer surface of the container rim 42 and lip 44 with the foil 46 therebetween. The lid 12 can thus be applied by automated capping equipment without damaging or deforming the foil 46.

The ledge portion 32 of the lid 12 enables a user to easily push up the lid 12 to release the internal rib 26 of the lid skirt portion 24 from engagement with the lower end edge 50 of the container peripheral lip 44. Also, the concave inner surface 30 of the lower most part of the lid skirt portion 24 enables the user to easily remove a container 40 with lid 12 from a store shelf.

The advantages of the invention will be readily apparent from the foregoing description of a preferred embodiment. It would also be noted that the relatively large flat upper surface area provided by the sheet-like body portion 14 can be readily printed upon by conventional printing equipment. Alternatively, the lid may be a see-through kind when made of transparent plastic material.

Other embodiments of the invention will be readily apparent to a person skilled in the art, the scope of the invention being defined in the appended claims.

I claim:

1. A plastic container lid formed by injection molding and comprising a sheet-like main body portion, a downwardly-open upwardly-extending hollow annular projection extending around the periphery of the body portion, said upwardly-extending annular projection having an inner wall extending upwardly from the periphery of the body portion, a top wall extending radially outwardly from the top of the inner wall and an outer wall extending downwardly from the outer periphery of the top wall, said inner and outer walls being substantially equal in height, an annular skirt portion extending outwardly from the lower end of the outer wall and curving to extend downwardly to a lower annular edge, said skirt portion having an internal annular rib extending around and projecting inwardly from the inner surface of the skirt portion, said internal rib extending inwardly for a distance sufficiently short so as not to reach an imaginary vertical line extending downwardly from a radially outer limit of the outer wall of the upwardly-extending annular projection and the height of the upwardly-extending annular projection above the main body portion being greater than the depth of the skirt portion below the main body portion to enable the lid to be stacked upon a like lid with the lower ends of the inner and outer walls of the upwardly-extending annular projection of the upper lid engaging the top wall of the upwardly-extending annular projection of the lower lid.

2. A container lid according to claim wherein the internal annular rib is spaced from the lower annular edge of the skirt portion.

3. A container lid according to claim 2 wherein the internal surface of the skirt portion between the internal annular rib and the lower annular edge is concavely curved.

4. A container lid according to claim 1 wherein the lower annular edge of the skirt portion has an annular ledge portion projecting radially outwardly therefrom.

5. A plastic lid and container assembly comprising a lid in accordance with claim 1 in snapping engagement on a container with an open top having a peripheral rim with a turned over downwardly-extending peripheral lip, the inner surface of the lid skirt portion between the upwardly-extending annular projection and the internal annular rib engaging the outer surface of the peripheral rim and lip of the container, the internal annular rib of the lid skirt portion having been snapped past the lower end edge of the peripheral lip of the container into engagement therewith, and the inner wall of the upwardly-extending annular projection of the lid being spaced radially inwardly of the rim of the container.

6. A lid and container assembly according to claim 5 wherein a foil extends across the top of the container in sealing engagement with the peripheral rim, with the sheet-like body portion of the lid being adjacent thereto.

* * * * *